United States Patent [19]

Forshee

[11] 4,386,277

[45] May 31, 1983

[54] X-RAY FACE MASK AND BIB DEVICE

[75] Inventor: David J. Forshee, Oxford, Mich.

[73] Assignee: Samuel Moti, Grosse Pointe Farms, Mich.

[21] Appl. No.: 198,599

[22] Filed: Oct. 20, 1980

[51] Int. Cl.[3] ..... G21F 3/02

[52] U.S. Cl. ..... 250/516.1; 2/9

[58] Field of Search ..... 250/515, 516, 519; 2/8, 9, 422, 424, 11

[56] References Cited

U.S. PATENT DOCUMENTS

| | | | |
|---|---|---|---|
| 1,191,274 | 7/1916 | Brayton | 250/516 |
| 1,191,773 | 7/1916 | Dinkuhn | 2/9 |
| 1,205,308 | 11/1916 | Work | 2/8 |
| 1,313,908 | 8/1919 | Polasky | 2/8 |
| 1,893,617 | 1/1933 | Flood | 2/11 |
| 2,725,559 | 12/1955 | Wagner | 2/8 |
| 3,707,004 | 12/1972 | Kapitan et al. | 2/424 |
| 3,879,761 | 4/1975 | Bothwell | 2/11 |
| 4,220,867 | 9/1980 | Bloch, Jr. | 250/516 |
| 4,286,170 | 8/1981 | Moti | 250/520 |

*Primary Examiner*—Alfred E. Smith
*Assistant Examiner*—Carolyn E. Fields
*Attorney, Agent, or Firm*—Harness, Dickey & Pierce

[57] ABSTRACT

A protective face mask to shield an x-ray technician or machine operator primarily from random secondary or scatter x-rays deflected toward his face, head and neck by the table, walls, equipment and other reflecting elements in an x-ray room, during the period of exposure while adjacent the object or person being exposed to the x-ray beam.

The face mask is formed of a lens portion supported in a plastic frame, upon the lower portion of which is removably attached a bib shield that in turn is removably attachable to an apron. The frame of the face mask, bib shield and apron are preferably lined with lead sheets to protect the neck, face, chest and body of the technician from the random secondary or scatter x-ray beams. The face mask and bib shield can be formed of a molded plastic material as a unitary device, the lens portion being attached to the frame therefor.

28 Claims, 16 Drawing Figures

X-RAY FACE MASK AND BIB DEVICE

CROSS REFERENCE TO A RELATED APPLICATION

This application is related to an earlier-filed copending application Ser. No. 120,687, now U.S. Pat. No. 4,286,170, filed by Samuel Moti on Feb. 11, 1980, entitled "X-Ray Face Mask and Chest Shield Device."

BACKGROUND OF THE INVENTION

It appears that x-ray technicians can become injuriously exposed to an accumulation of random deflected secondary or scatter x-rays over a period of time when they are and work closely or directly adjacent to the body of the object being exposed to the x-ray beam during an x-ray exposure period. Such potential or actual radiation injury is desirably to be avoided. The instant invention was designed to provide protection against such injury.

In taking x-ray images of children and animals, it is difficult to get satisfactory exposures if the child or animal is allowed to remain on the table by itself. It is almost always necessary to hold the child or animal still and substantially motionless during the x-ray exposure period, short as that may be. During this period, the technician wears a rubber or plastic apron and gloves which are filled with or contain a lead lining in one form or another, to absorb or resist the direct and reflected x-ray beam and rays. But heretofore, he has had no protection for his upper chest, face, head and neck, from random of secondary x-rays deflected by the walls and equipment in the x-ray chamber or room. This invention was designed to provide such protection to the technician who is directly adjacent the body of the object being exposed to the direct x-ray beam.

Another source of radiation danger is present for doctors or other technicians who use fluoroscopy in cardiovascular analysis or treatment, wherein dye-containing catheters or probes are inserted into main arteries or other passages under precisely controlled conditions. Exposure to a relatively high level of radiation occurs in such treatment, which requires the doctor to position himself in the direct path of the x-ray beam, subjecting him to cumulatively high quantities of radiation in a relatively short period of time.

When a patient is being exposed to an x-ray beam for chest examination, he is usually placed adjacent a wall of the film carrier machine with his chest to the wall, the back of his head and neck facing the projector portion of the x-ray beam equipment. At this time, there is no protection afforded such body portions against direct and indirect exposure of the x-ray beam and deflected rays. This invention provides such protection when the face mask and chest shield device are mounted on the patient in reverse attitude whereby the back of the head, neck and shoulders are shielded from such x-ray beam and secondary rays.

SUMMARY OF THE INVENTION

The face mask and chest shield or bib device of this invention comprises two principal components removably attachable together for mounting upon the shoulders of a person in facing or reverse attitude whereby the person's head, face, neck and shoulders are protected from random deflected x-rays, or the direct x-ray beam, during the x-ray exposure period.

In one embodiment, the face mask is preferably made of and comprises a substantially semi-circular or arcuate relatively transparent plate or sheet of plastic material designed to cover the front and sides of the head and neck in one aspect when used by an x-ray technician, and the back and sides of the head and neck in another aspect when used by a patient being exposed to the x-ray beam for chest or upper body study. The thickness of the face mask can be varied, as can the density or proportion of the lead salt contained in the plastic material. The thickness of the plastic face mask sheet or plate and the proportion of the lead contained therein depends to a very large degree upon the intensity of the x-ray beam directed to the object under examination. In a second embodiment, the face mask comprises a transparent lens portion mounted in a plastic frame which may be lined, in whole or in part, with a radiation-absorbing lead sheet.

The transparent mask or lens is preferably made of a plastic material such as, but not limited to DuPont's "SURLYN" (trademark) material which is a nylon, relatively transparent, lead salt ionomer compound containing a weight percent of lead up to about 18% to 20%. Higher proportions of lead salt can also be used. Reference is made particularly to DuPont's U.S. Pat. No. 3,264,272 for the lead-containing plastic material described in Column 5, lines 27, 75 and Column 6, lines 1–4, among others as disclosed therein. Lead (Pb), being a Group IV-A metal, comes within the compass of the patent claims 6 and 22. The face mask or lens can also be made of an acrylic resin which contains a lead salt.

The chest shield or bib is preferably fabricated of a rubber or plastic sheet material suitably impregnated or filled with a lead material such as lead sheet or film, or with lead particles or salt compound. It need not be transparent. The chest shield is designed for removable attachment to the face mask by suitable fasteners such as for example snap-type fasteners which are relatively easily engaged and disengaged, or by Velcro strips adhesively secured to the lower lip of the face mask and to portions of the chest shield or bib.

The chest shield, in one embodiment, is provided with a generally circular chest covering web or body portion and a pair of substantially parallel shoulder straps extending from each end of the body portion. These shoulder straps may be weighted or unweighted depending upon their flexibility and retention characteristics when placed upon the technician's or patient's shoulders. In a second embodiment, the chest shield or bib is provided on its underside at its distal end portions with Velcro strips that removably attach the bib to complementary Velcro strips secured to the shoulder portions of the conventional lead lined apron worn by most x-ray technicians.

A principal object of the invention is to provide a radiation protective device for an x-ray technician when in closely adjacent proximity to an object being exposed to an x-ray beam from exposure of his face, head, neck and upper chest to random secondary or scatter x-rays deflected from equipment in or walls of an x-ray chamber or room, during the x-ray exposure period.

Another principal object of the invention is to provide a protective device for a patient being exposed to an x-ray beam for chest or upper torso study or investigation from direct exposure to the back or sides of his head, face, neck and shoulders, during the x-ray exposure period.

Another object of the invention is to provide a relatively stable radiation protective device removably mountable upon the shoulders of the x-ray technician or patient, which comprises a substantially transparent face mask or lens and a removably attachable chest shield or bib made of material which substantially absorbs, and/or resists the transmission of random deflected x-rays or x-ray beams, so as to protect such persons from an accumulation, over a period of time, of injurious radiation.

These and other objects and advantages of the invention will become more apparent by reference to the following detailed specification to be read in context with the attendant drawings.

DESCRIPTION OF PREFERRED EMBODIMENTS

Figure 1:
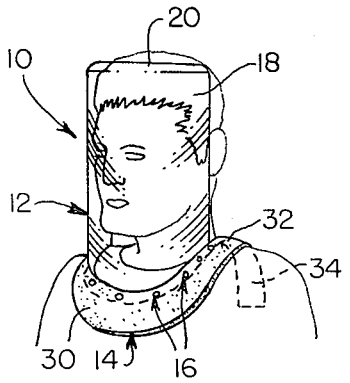
FIG. 1 is a perspective view of the face mask and chest shield device mounted upon the shoulders of a person, such for example as an x-ray technician, to protect him from random deflected secondary x-rays.
Figure 2:
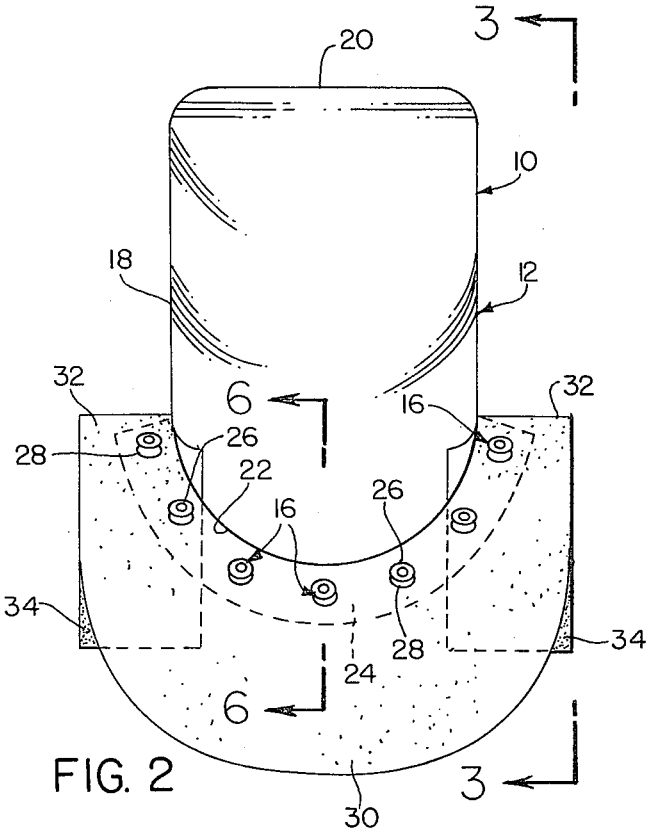
FIG. 2 is a front elevational view taken substantially on the line 2—2 of FIG. 1.
Figure 3:
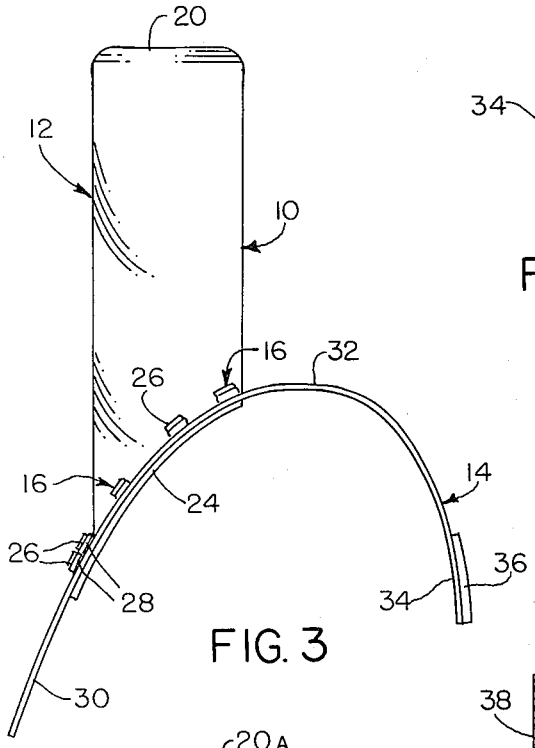
FIG. 3 is a side elevational view taken substantially on the line 3—3 of FIG. 1.

As shown particularly in FIGS. 1–6 of the drawings, one embodiment of the radiation protective device 10 comprises a face mask 12 and a chest shield 14 removably attachable together by suitable fasteners 16, such for example as the two-piece snap type.

The face mask 12 is made of a substantially transparent lead containing ionomer, such for example, as DuPont's "SURLYN" material according to U.S. Pat. No. 3,264,272, containing up to about 18% to 20% or more by weight of a lead salt as defined in claims 6 and/or 22 of said patent. Alternatively, the face mask can be made of a lead-containing acrylic resin. The radiation absorption capabilities of the lead salt-containing ionomer are designed to provide the radiation protection that the x-ray technician requires, when handling a small child or animal on the table during its exposure to direct x-ray beams, from secondary radiation or soft or scatter rays which may be deflected toward his face, head and/or neck.

In all these operations, the technician wears a radiation protective lead-lined apron which covers his chest, torso and legs. The apron is or may be of the style and construction disclosed in Maine U.S. Pat. No. 3,093,829 for Protective Apron Construction, or of any other suitable style and construction. The face mask and chest shield device 10 of this invention is used in addition to such apron structure.

The face mask 12 comprises a relatively clear transparent body portion 18 of semi-circular, somewhat partially cylindrical, or arcuate form having upper and lower margins 20, 22 respectively, the lower arcuate margin terminating in an outwardly projecting arcuate lateral flange 24 provided with a plurality of fastener members 26 adapted to be removably secured to complementary fastener members 28 mounted upon or attached to the chest shield 14.

The face mask 18, made of the above-described lead containing "SURLYN" material, is designed to protect the front and sides of the head and neck, extending rearwardly to a line beyond the temples of the wearer. The body portion may be of any suitable thickness adequate to provide protection against the secondary radiation for which the invention was created.

The chest shield or bib 14 comprises a lead-lined, lead-filled, or lead-containing opaque rubber or plastic body or sheet of material having the fastener members 28 affixed thereto in a pattern in register with the fastener members 26 affixed to the face mask flange 24. The medial web or body portion 30 is generally circular or arcuate and terminates at each lateral end in shoulder straps 32, 32 which are generally parallel to each other and of a length suitable to rest upon the shoulders and somewhat down upon the back of the wearer. The distal ends, 34, 34 of the straps 32, 32 may be provided with lead weights 36, 36 or other suitable weights to balance the load applied by the face mask 12 and the chest shield 14 directed forwardly.

Figure 5:
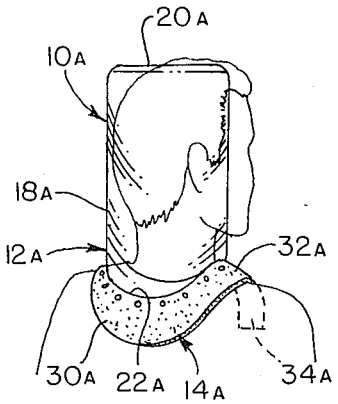
FIG. 5 is a view similar to FIG. 1, showing the face mask and chest shield device mounted reversely upon the shoulders of a patient being subject to a chest or upper torso study or examination, for protection against direct x-ray beam exposure to the back and sides of his head, neck and shoulders.
Figure 6:
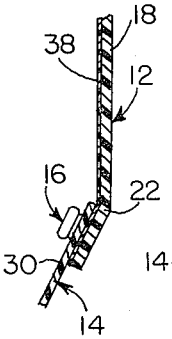
FIG. 6 is a vertical sectional view taken substantially on the line 6—6 of FIG. 2.
Figure 4:
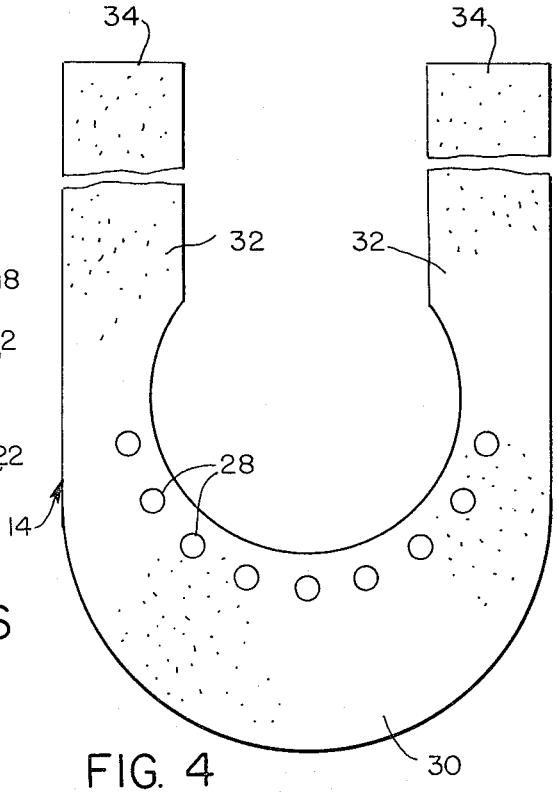
FIG. 4 is a top plan view of the chest shield portion of the device illustrated in FIG. 1.
Figure 7:
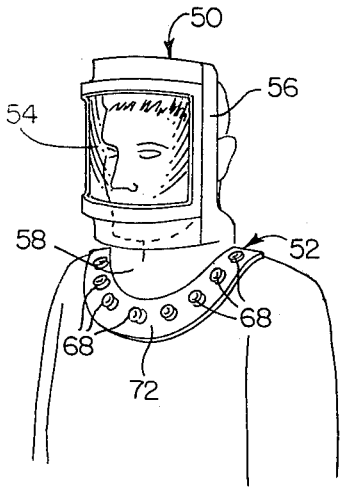
FIG. 7 is a perspective view of a second embodiment of the invention, illustrating a face mask having a lens portion mounted in a plastic frame to which is attached a bib in turn removably attached to a conventional lead-lined x-ray technician's apron.
Figure 8:
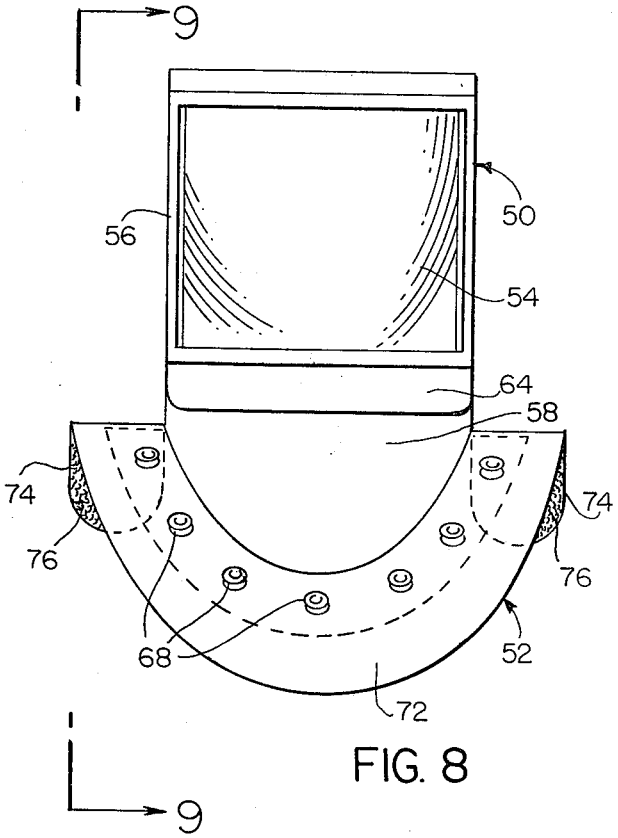
FIG. 8 is a front elevational view of the face mask and bib illustrated in FIG. 7.
Figure 9:
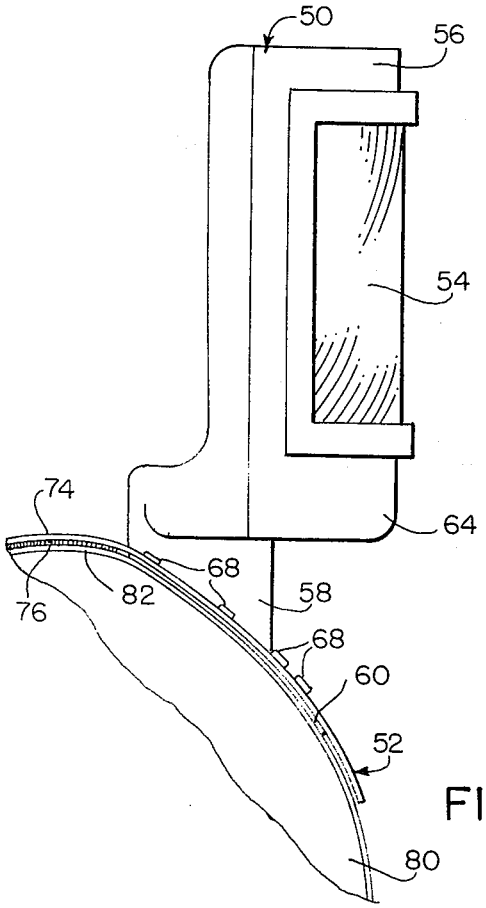
FIG. 9 is a side elevational view taken substantially on the line 9—9 of FIG. 8.
Figure 10:
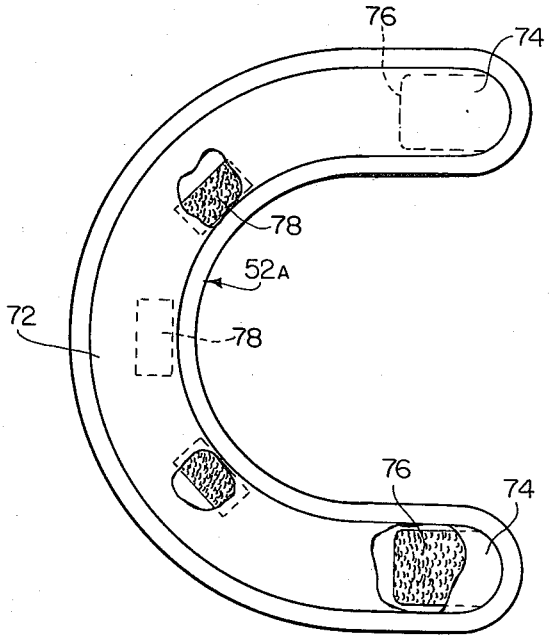
FIG. 10 is a top plan view with portions broken away of a modified form of the bib illustrated in FIGS. 7, 8 and 9.
Figure 11:
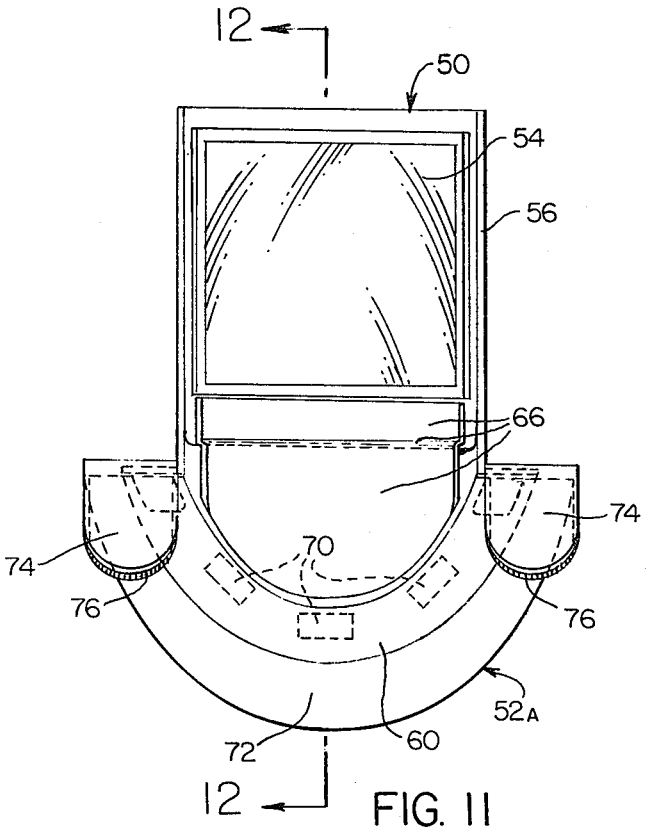
FIG. 11 is a rear elevational view of the face mask and bib shown in FIGS. 7 and 8, slightly modified.

FIG. 5 is an illustration of the device 10 being used in reverse fashion, as for example by a patient who is being x-rayed for chest study and examination. In such event, the patient wears no apron but only the device 10 which is now positioned upon his shoulders with the shoulder strap ends **34*a*, 34*a* directed forwardly and the body portion 30*a* of the bib shield 14*a* resting adjacent or just below the back of his neck. The face mask 12*a*** now shields the back and rear sides of the patient's head and neck to protect him against direct beam, as well as secondary radiation x-rays.

A slight modification of the face mask 12 (FIG. 6) involves its lamination with a physically protective outer layer 38 of a clear transparent film such as DuPont's "MYLAR" material which comprises a polyester resin made by the condensation of a terephthalic acid and ethylene glycol.

The tough MYLAR layer is preferably laminated or adhered to the entire facing surface of the face mask SURLYN material by a suitable adhesive or other means to provide a physically protective layer against scratching of the outer surface of the face mask. Such scratching or abrasive effects, applied physically, could well interfere with the clarity or transparency of the face mask. It would be desirable to avoid such deleterious conditions by use of an outer MYLAR layer or by other suitable coating.

Another advantage of the device 10 resides in the fact that the face mask 12 is made of a plastic material which is far less frangible than a lead-containing glass which is much heavier and more fragile than the lead-containing SURLYN plastic. If the plastic face mask is covered by an adhered MYLAR laminate layer, it is further reinforced against breakage.

A second embodiment of the invention comprises the face mask 50 and the bib 52, illustrated in FIGS. 7–13.

The face mask 50 comprises the lens portion 54, the lens frame 56, the neck shield portion 58 and the bib lip 60 depending therefrom. The frame 56, neck shield portion 58 and bib lip 60 are made of a sturdy, plastic material, such for example as DuPont's ST (Super Tough) Nylon, as a unitary integrally molded device.

The frame portion surrounding the lens 54 and the lens are preferably made arcuate in one direction, although they may take other shapes as circumstances of use require. The lens can be attached to frame 56 in a number of ways, as for example by double-faced adhesive strips 62, 62 at the upper and lower edges of the lens (FIG. 12), or by clips affixed to the frame and partially overlying the edges of the lens, or by any other suitable means.

Figure 12:
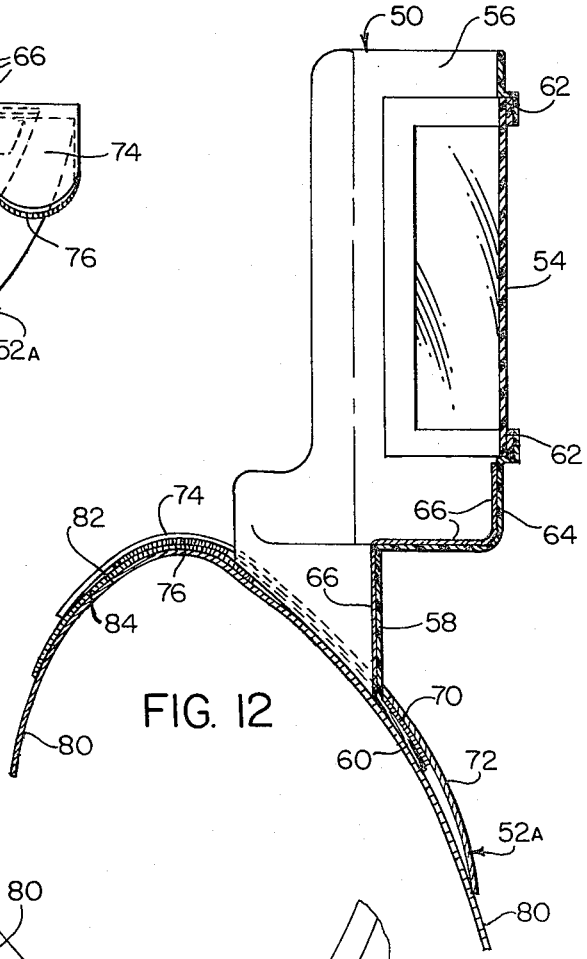
FIG. 12 is a vertical sectional view taken substantially on the line 12—12 of FIG. 11.
Figure 13:
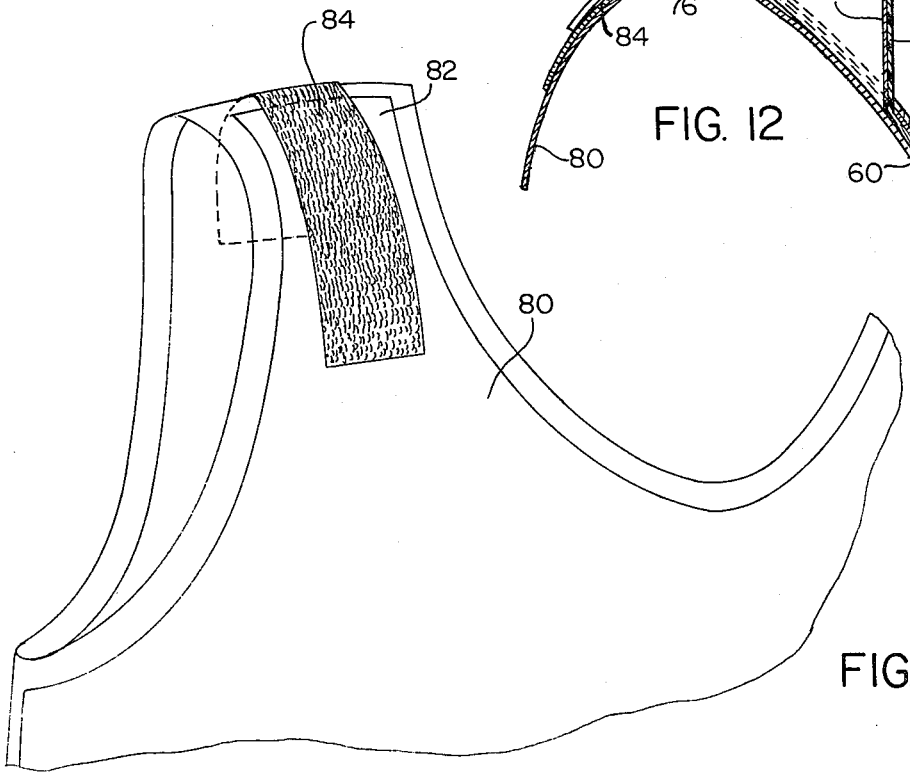
FIG. 13 is a fragmentary perspective view of a shoulder portion of a conventional x-ray technician's lead-lined apron.

As shown particularly in FIG. 12, the frame 56 of the face mask is lined at least on its inner surface at the chin portion 64, and neck portion 58 with lead sheet material 66 which is secured to the inner surface by an adhesive or other suitable means. The chin portion 64 preferably extends generally inwardly below the chin of the wearer, and the neck portion 58 preferably extends downwardly from an inward portion of the chin overlying portion and rearwardly generally adjacent the lateral sides of the wearer's neck.

The bib lip 60 is provided in one arrangement with a plurality of snap fasteners members 68 that are removably attached to complementary snap fastener members 68, affixed to the bib 52, whereby the lead-lined bib rests fully secured upon the bib lip 60. In a second alternative arrangement (FIG. 11), the bib lip 60 is provided with a plurality of Velcro fastening strips 70 secured to the upper surface of the lip by adhesive or other suitable and adequate means.

The bib 52 comprises a lead-lined flexible plastic or fabric body having a web portion 72, to the underside of which are secured a plurality of the complementary snap fastener members 68, and its distal end portions 74, 74 to the underside of which are secured Velcro fastening strips 76, 76 by adhesive or other suitable means.

The slightly modified bib **52*a* (FIGS. 10, 11 and 12) comprises the web portion 72 to the underside of which are affixed a plurality of Velcro fastening strips 78 by adhesive or other suitable means. The bib Velcro strips 76 removably attach the bib 52*a* to the conventional x-ray technician's lead-lined apron 80 which is provided on its shoulder portions 82 with a relatively elongated Velcro fastening strip 84** by adhesive, sewing, or other suitable means. The bib and face mask are thus adjustably secured upon the shoulders of the wearer in any comfortable and suitably protective position.

Figure 14:
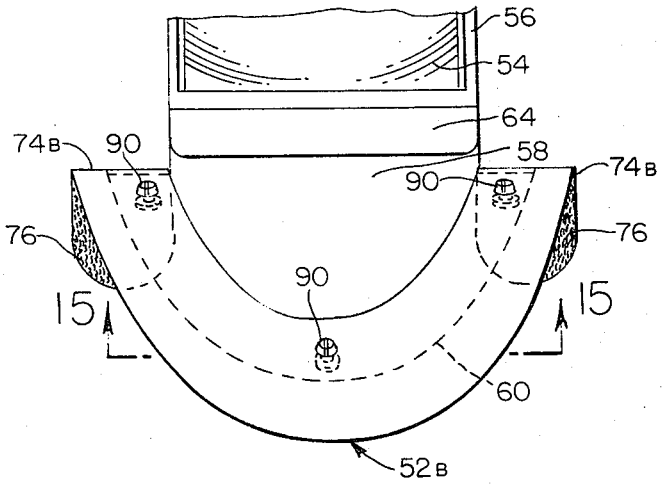
FIG. 14 is a fragmentary front elevational view of the face mask and bib similar to that in FIG. 8, showing another form of attachment at the shoulder portions of the face mask lip and bib.
Figure 15:
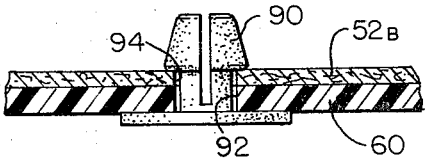
FIG. 15 is a vertical sectional view, partially in elevation, taken substantially on the line 15—15 of FIG. 14.

A further modification of the face mask and bib, illustrated in FIGS. 14 and 15, provides for the application of Velcro strips 76, 76 to the underside of the bib **52*a* at its distal ends 74*b*, 74*b* by an adhesive or other suitable fastening means. The bib 52*b* is removably attachable to the face mask lip 60 by split-type fasteners 90 which are placed through openings 92 in the face mask lip and openings 94 in the bib positioned in register with each other. The fasteners 90 permit facile removable attachment of the bib to the mask lip, and are preferably made of a suitable plastic material having resilient flexible characteristics. In other respects the bib 52*b* is similar to the bib shields 52 and 52*a*** earlier described.

Figure 16:
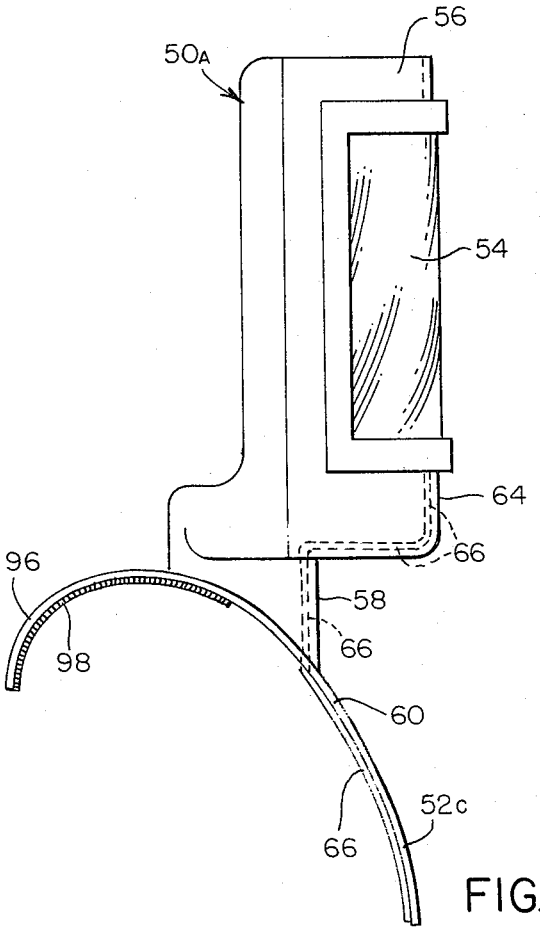
FIG. 16 is a side elevational view similar to that in FIG. 9, showing a bib portion and shoulder loops molded with the face mask frame and lip, as an integral unit.

Yet a further modification, illustrated in FIG. 16, provides for a molded plastic unitary face mask and bib structure **50*a*. The face mask 50 is formed with its lens frame 56, chin shield portion 64, neck shield portion 58, lip portion 60 and the bib shield portion 52*c*, as an integral unit. The bib shield portion 52*c* comprises a lower and lateral extension of the lip portion 60, and further comprises the shoulder loops 96 at the distal ends of the bib shield portion, to overlay the shoulders of the wearer and for securement upon the apron shoulder velcro portions 84. To secure the unitary face mask 50*a* to the apron 80, the undersides of the shoulder loops 96 are each provided with complementary velcro strips 98**.

The Velcro fastening strips are complementary in structure, one layer comprising a plurality of closed spaced male barbs or hooks affixed to a base and a second layer comprising a plurality of closely spaced loops affixed to a base. One Velcro strip base is affixed to the underside of the bib or bib portions, another to the face mask lip, and a third to the apron shoulders.

The mask frame 56 is preferably lined substantially entirely on its inner surface with a lead sheet material, or it may be sufficient, in some instances, to line just the chin, neck and lip portions 64, 58 and 60 respectively, with lead sheet, for protection against the scatter or direct beam x-ray radiation.

Although the disclosure made herein is substantially detailed to enable those skilled in the art to practice the invention, it is to be understood that the physical embodiments herein described are merely exemplifications of structures which are considered functionally useful or suitable for embodiment in other specific structures. The scope of the invention is defined in the claims appended hereto.

We claim:

1. An improved device for shielding and protecting a person against direct and scatter x-ray radiation to the face, head and neck, and to be worn on the shoulders of such person, wherein the improvement comprises a radiation shielding face mask comprising a lead-filled relatively clear transparent radiation shielding lens, a frame composed of a molded plastic material for said lens secured thereto in face and head shielding posture, said frame further comprising radiation shielding chin and neck overlying portions, at least part of said chin overlying portion extending generally inward below the chin of said person and at least part of said neck overlying portion extending generally vertically from an inward portion of said chin overlying portion and extending rearwardly adjacent at least one lateral side of the neck of said person when said device is worn by said person, and a distal lip extending from said neck overlying portion, said chin and neck overlying portions being substantially continuous with said frame and integrally formed with said frame, at least said chin and neck overlying portions further including a radiation-shielding lead lining on their inner surfaces, and a radiation shielding bib for the upper chest portion of said person removably attached to said distal lip.

2. The device defined in claim 1, wherein said radiation shielding bib is also provided with means adapted to be removably attachable to a radiation shielding apron worn by the person.

3. The device defined in claim 1, further comprising means for attaching said bib to said lip, said means being affixed to said lip.

4. The device defined in claim 1, wherein the entire inner surface of said frame is covered with a radiation shielding lead lining.

5. The device defined in claim 1, wherein said lens is integrally formed of an acrylic lead-containing material.

6. The device defined in claim 1, wherein said distal lip and bib are each provided with complementary fastening means affixed thereto for removable attachment of said face mask and bib.

7. The device defined in claim 6, wherein said complementary fastening means comprises a plurality of pairs of snap fasteners, one of which is affixed to said distal lip and the other affixed to said bib for mating facing conjunction.

8. The device defined in claim 6, wherein said complementary fastening means comprises complementary Velcro strips, one of which is affixed to said distal lip and the other affixed to said bib for mating facing conjunction.

9. The device defined in claim 1, wherein said bib is provided with a radiation shielding lead lining and comprises an intermediate web portion and distal end portions, said web portion being removably attached to said distal lip.

10. The device defined in claim 9, wherein said bib distal end portions are provided on their underside with means removably attachable to the shoulder portions of a radiation shielding apron worn by the person.

11. The device defined in claim 1, wherein said distal lip and bib are removably attached together by fastening means passed through said lip and bib.

12. The device defined in claim 11, wherein said fastening means comprises a plurality of split fasteners, the shanks of which secure said lip and bib at openings therethrough.

13. The device defined in claim 11, wherein said fastening means removably attach said bib to said lip at least at the upper distal ends of said lip.

14. An improved device for shielding and protecting a person against direct and scatter x-ray radiation to the face, head and neck, and to be worn on the shoulders of such person, wherein the improvement comprises in combination a radiation shielding face mask, a radiation shielding bib, and a radiation shielding apron, having shoulder portions to overlie and rest upon the shoulders of said person, said face mask comprising a lead-filled relatively clear transparent lens, a frame for said lens secured thereto in face and head shielding posture, said frame further comprising radiation shielding chin and neck overlying portions, at least part of said chin overlying portion extending generally inward below the chin of said person and at least part of said neck overlying portion extending generally vertically from an inward portion of said chin overlying portion and extending rearwardly adjacent at least one lateral side of the neck of said person when said device is worn by said person, and a distal lip extending from said neck overlying portion, said chin and neck overlying portions being substantially continuous with said frame and integrally formed with said frame from a molded plastic material, at least said chin and neck overlying portions further comprising a radiation-shielding lead lining on their inner surfaces, said bib being removably attached to said distal lip and extending over at least a portion of the upper chest of said person, said bib being removably attached to the shoulder portions of said apron.

15. The improved combination defined in claim 14, wherein said apron is provided at its shoulder portions with means removably attached to said bib.

16. The improved combination defined in claim 15, wherein said apron shoulder portions and distal end portions of said bib are each provided with complementary fastening means comprising complementary Velcro strips, one of which is affixed to each of said bib distal end portions and the other affixed to each of said apron shoulder portions for mating facing conjunction.

17. The improved combination defined in claim 14, wherein said bib is provided with a radiation shielding lead lining.

18. The improved combination defined in claim 14, wherein said apron is provided with a radiation shielding lead lining.

19. The improved combination defined in claim 14, wherein said distal lip and bib are each provided with complementary fastening means affixed thereto for removable attachment of said face mask and bib.

20. The improved combination defined in claim 19, wherein said complementary fastening means comprises a plurality of pairs of snap fasteners, one of which is affixed to said distal lip and the other affixed to said bib for mating facing conjunction.

21. The improved combination defined in claim 19, wherein said complementary fastening means comprises complementary Velcro strips, one of which is affixed to said distal lip and the other affixed to said bib for mating facing conjunction.

22. The improved combination defined in claim 14, wherein said bib is provided with a radiation shielding lead lining and comprises an intermediate web portion and distal end portions, said web portion being removably attached to said distal lip.

23. An improved device for shielding and protecting a person against direct and scatter x-ray radiation to the face, head and neck, and to be worn on the shoulders of such person, wherein the improvement comprises a radiation shielding face mask comprising a lead-filled relatively clear transparent radiation shielding lens, a frame for said lens secured thereto in face and head shielding posture, said frame further comprising radiation shielding chin and neck overlying portions, at least part of said chin overlying portion extending generally inward below the chin of said person and at least part of said neck overlying portion extending generally downwardly from an inward portion of said chin overlying portion and extending rearwardly adjacent at least one lateral side of the neck of said person when said device is worn by said person, and a distal lip extending from said neck overlying portion, said chin and neck overlying portions being substantially continuous with said frame and integrally formed with said frame, at least said chin and neck overlying portions further including a radiation-shielding lead lining on their inner surfaces, and a radiation shielding bib portion extending from and outwardly of said lip to overlie upper portions of the person's chest and shoulders, said bib portion terminating at its distal ends in shoulder loops adapted to overlie and rest upon upper portions of the person's shoulders.

24. The device defined in claim 23, wherein said bib portion shoulder loops are provided with means removably attachable to a radiation shielding garment worn by the person.

25. The device defined in claim 23, wherein said frame, chin and neck overlying portions, bib portion and shoulder loops are integrally formed of a molded plastic material as a unitary device.

26. The device defined in claim 25, wherein said radiation shielding lead lining is secured to said frame.

27. The device defined in claim 23 wherein said lens is integrally formed of an acrylic lead-containing material.

28. An improved device for shielding and protecting a person against direct and scatter x-ray radiation to the face, head and neck, and to be worn on the shoulders of such person, wherein the improvement comprises a radiation shielding face mask comprising a lead-lined frame and a lead-containing relatively clear transparent radiation shielding lens mounted in said frame, said frame being supportable upon the shoulders of said person, and a first portion of said frame extending generally inward below the chin of said person when said device is worn by said person, and a second portion of said frame extending generally vertically from an inward portion of said first portion and extending generally rearwardly adjacent at least one lateral side of the neck of said person when said device is worn by said person, said first and second portions being substantially continuous with said frame and integrally molded with said frame from a plastic material.

* * * * *